US009784149B2

(12) United States Patent
Matsuda et al.

(10) Patent No.: US 9,784,149 B2
(45) Date of Patent: Oct. 10, 2017

(54) OIL STRAINER AND OIL STORAGE DEVICE FOR VEHICLE

(71) Applicant: Kawasaki Jukogyo Kabushiki Kaisha, Hyogo (JP)

(72) Inventors: Yoshiharu Matsuda, Akashi (JP); Kazuki Arima, Kobe (JP); Yasushi Ishibashi, Akashi (JP); Shingo Tanimoto, Inami-cho (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 190 days.

(21) Appl. No.: 14/540,888

(22) Filed: Nov. 13, 2014

(65) Prior Publication Data

US 2015/0136064 A1 May 21, 2015

(30) Foreign Application Priority Data

Nov. 19, 2013 (JP) ..... 2013-238742

(51) Int. Cl.
*F01M 11/00* (2006.01)

(52) U.S. Cl.
CPC ... *F01M 11/0004* (2013.01); *F01M 2011/007* (2013.01)

(58) Field of Classification Search
CPC ..... F01M 11/0004
USPC ..... 123/196 A
See application file for complete search history.

(56) References Cited

U.S. PATENT DOCUMENTS

| | | | | |
|---|---|---|---|---|
| 6,390,947 | B1 * | 5/2002 | Aoki | B60W 10/06 477/156 |
| 6,428,699 | B1 * | 8/2002 | Iwata | B29C 65/20 210/167.02 |
| 7,318,405 | B2 | 1/2008 | Tanaka et al. | |
| 2006/0201742 | A1 * | 9/2006 | Terashima | B62K 19/30 181/227 |
| 2007/0062480 | A1 | 3/2007 | Tanaka et al. | |

FOREIGN PATENT DOCUMENTS

| | | | | |
|---|---|---|---|---|
| JP | 03-042009 | | 4/1991 | |
| JP | 03-119514 | | 12/1991 | |
| JP | 10-047031 | | 2/1998 | |
| JP | 2006-322408 | | 11/2006 | |
| JP | 2007-077925 | | 3/2007 | |
| JP | 2007-170189 | | 7/2007 | |
| JP | 2013-136976 | * | 7/2011 | F01M 11/00 |
| WO | WO 01/90539 | | 11/2001 | |

OTHER PUBLICATIONS

Notification of Reason(s) for Rejection Issued Feb. 28, 2017 for Corresponding Japanese Patent Application No. 2013-238742 with English Language Summary (4 pages).

* cited by examiner

*Primary Examiner* — Kevin Lathers

(57) ABSTRACT

An oil strainer which sucks an oil is disposed within an oil pan connected to a lower portion of a combustion engine. The oil strainer includes a strainer main body, which accommodates a filter element and extends so as to be inclined relative to a horizontal line, a suction port formed in a lower portion of the strainer main body, and a discharge port formed in an upper portion of the strainer main body.

9 Claims, 5 Drawing Sheets

OIL STRAINER AND OIL STORAGE DEVICE FOR VEHICLE

CROSS REFERENCE TO THE RELATED APPLICATION

This application is based on and claims Convention priority to Japanese patent application No. 2013-238742, filed Nov. 19, 2013, the entire disclosure of which is herein incorporated by reference as a part of this application.

BACKGROUND OF THE INVENTION

Field of the Invention

The present invention relates to an oil strainer which is disposed within an oil pan connected to a lower portion of a combustion engine and sucks oil, and an oil storage device for a vehicle including the oil strainer.

Description of Related Art

In a combustion engine mounted on a vehicle such as a motorcycle, an oil pan is disposed at a lower portion of the combustion engine, and oil is supplied to each component of the combustion engine by an oil pump which drives in conjunction with the combustion engine. An oil strainer is disposed between the oil pan and the oil pump in order to remove solid components from the oil (e.g., JP Laid-Open Patent Publication No. 2007-077925). The oil strainer includes a strainer main body forming a portion of an oil passage and an oil filter accommodated within the strainer main body, which oil filter removes solid components or debris.

The conventional oil strainer 200, as shown in FIG. 6B includes a filter housing portion 202 having a large passage area provided in a strainer main body 201 and an oil filter 204 disposed in the filter housing portion 202. Accordingly, the filter area is increased, and the passage resistance when the oil passes through the oil filter 204 is decreased.

When the combustion engine stops, the oil pump also stops, and thus, the oil within the strainer main body 201 returns to the oil pan. However, in the oil strainer 200 in FIG. 6B, when the combustion engine is stopped, a part 206 of the oil remains within the filter housing portion 202 in some cases. In such a case, even if the oil within the oil pan is discharged at the time of oil changing, the part 206 of the oil remaining within the filter housing portion 202 is not discharged.

SUMMARY OF THE INVENTION

An object of the present invention is to provide an oil strainer which is able to suppress remaining of oil within a strainer main body, and an oil storage device for a vehicle including the oil strainer.

In order to achieve the above-described object, an oil strainer according to the present invention is an oil strainer which is disposed within an oil pan connected to a lower portion of a combustion engine and sucks an oil. The oil strainer includes: a strainer main body accommodating a filter element and extending along an inclined reference surface inclined relative to a horizontal line; a suction port formed in a lower portion of the strainer main body; and a discharge port formed in an upper portion of the strainer main body.

According to this configuration, since the strainer main body which accommodates the filter element is inclined, when the combustion engine is stopped, an oil within the oil strainer flows and drops via the suction port into the oil pan.

Thus, the oil is prevented from remaining within the strainer main body. Accordingly, deteriorated oil is easily discharged at the time of oil replacement.

In the oil strainer according to the present invention, the filter element is preferably disposed so as to be inclined parallel to the inclined reference surface. According to this configuration, since the filter element is disposed along a direction in which the strainer main body extends, the filter area is increased as compared to the case where the filter element is horizontally disposed, and therefore, the passage resistance is decreased.

In the oil strainer according to the present invention, preferably, the strainer main body is configured with two pan-shaped members joined together, the two pan-shaped members being separable from each other in a direction perpendicular to the inclined reference surface, and the filter element is disposed at an abutting surface where the two pan-shaped members abut each other. According to this configuration, the filter element which is disposed so as to be inclined is allowed to easily be disposed within the oil strainer. Furthermore, since the filter element is disposed at the abutting surface of the two pan-shaped members, it is easy to mount and dismount the filter element, and as a result, the maintenability improves.

An oil storage device for a vehicle according to the present invention includes the oil strainer according to the present invention and the oil pan. An inclined surface is formed on an inner bottom surface of the oil pan so as to extend gradually upwardly in one of frontward and rearward directions of the vehicle, and the oil strainer is disposed along the inclined surface. According to this configuration, it is possible to dispose the inclined strainer main body in accordance with the shape of the oil pan. In addition, even when the vehicle accelerates or decelerates, by positioning the suction port in a deepest portion of the oil pan, it is possible to stably suck the oil within the oil pan.

In the oil storage device for the vehicle according to the present invention, preferably, a discharge pipe portion having the discharge port is inserted into a connection portion provided in a crankcase of the combustion engine, from below, a support surface is formed on the strainer main body, and a seating surface on which the support surface is seated is formed on the inclined surface. According to this configuration, owing to the seating surface and the insertion structure, it is possible to stably support the oil strainer by the oil pan.

In the oil storage device for a vehicle according to the present invention, an inlet through which an oil is introduced into the oil pan preferably confronts an upper surface of the strainer main body from above. In this case, the inlet is, for example, an outlet of a relief valve of an oil passage. According to this configuration, even when the inlet is formed at a high position, the oil comes into contact with the upper surface of the strainer main body, then flows along the inclined surface of the strainer main body, and drops into the oil pan. Thus, it is possible to suppress occurrence of bubbles in the oil as compared to the case where the oil directly drops from the inlet onto an oil surface.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

A preferred embodiment of the present invention will now be described in detail with reference to the accompanying drawings, noting that the terms "left" and "right" used in the description in this specification are relative terms denoting respective position and/or directions relative to a motorcycle driver or motorcyclist maneuvering the motorcycle to travel forwards.

Figure 1:
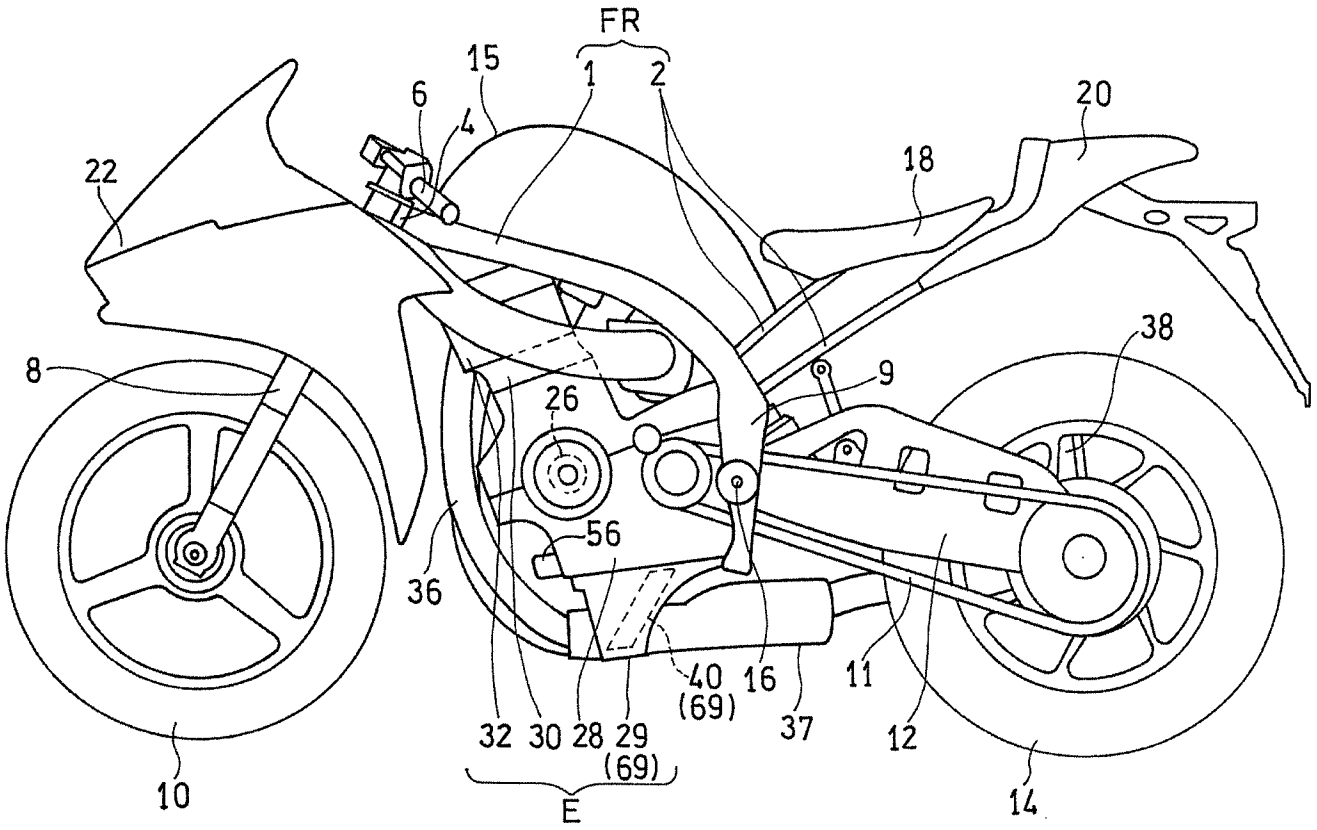
FIG. 1 is a side view showing a motorcycle equipped with a combustion engine including an oil storage device according to a first embodiment of the present invention.

FIG. 1 is a side view of a motorcycle which is one type of a vehicle equipped with a combustion engine including an oil storage device according to a first embodiment of the present invention. A motorcycle frame structure FR for the motorcycle includes a main frame 1, forming a front half of the motorcycle frame structure FR, and a seat rail 2 forming a rear half of the motorcycle frame structure FR. The seat rail 2 is mounted on a rear portion of the main frame 1. The main frame 1 has a front end provided with a head pipe 4, and a front fork 8 is rotatably supported by this head pipe 4 via a steering shaft (not shown). A front wheel 10 is fitted to a lower end portion of the front fork 8, and a steering handle 6 is fixed to an upper end portion of the front fork 8.

Meanwhile, a swingarm bracket 9 is provided at a rear end portion of the main frame 1 which is a lower intermediate portion of the motorcycle frame structure FR. A swingarm 12 is supported for movement in up and down direction about a pivot pin 16 fitted to the swingarm bracket 9. A rear wheel 14 is rotatably supported by a rear end portion of the swingarm 12. A motorcycle combustion engine E, which is a drive source, is fitted to the lower intermediate portion of the motorcycle frame structure FR at the front side of the swingarm bracket 9. This combustion engine E drives the rear wheel 14, which is a driven portion, via a drive chain 11. The combustion engine E is in the form of a parallel four-cylinder, four-stroke water-cooled combustion engine. It is, however, to be noted that the number of cylinders and stroke type of the combustion engine E are not necessarily limited to those described above.

The combustion engine E includes a crankshaft 26 which has a rotation axis extending in a right-left direction (vehicle widthwise direction), a crankcase 28 which supports the crankshaft 26, an oil pan 29 which is connected to a lower portion of the crankcase 28, a cylinder block 30 which projects upward from an upper surface of the crankcase 28, and a cylinder head 32 which is provided at the upper side of the cylinder block 30.

Four exhaust pipes 36 are fluid connected with four exhaust ports in a front surface of the cylinder head 32, respectively. Those four exhaust pipes 36 are merged together at a merging exhaust pipe 37 below the combustion engine E and are then fluid connected with a muffler 38 disposed at the right side of the rear wheel 14.

A fuel tank 15 is disposed on an upper portion of the main frame 1 and a driver's seat 18 and a fellow passenger's seat 20 are supported by the seat rail 2. Also, a cowling 22 made of a resinous material is mounted on a front portion of the motorcycle frame structure FR.

An oil strainer 40 which sucks an oil OL to filter is disposed within the oil pan 29. The oil pan 29 and the oil strainer 40 constitute an oil storage device 69 for a motorcycle.

Figure 2:
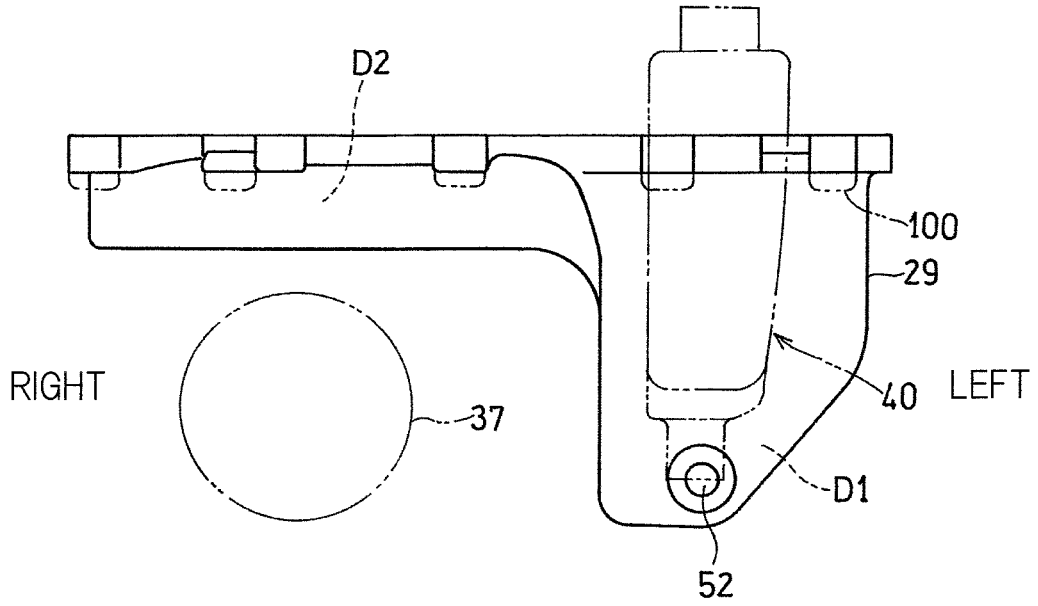
FIG. 2 is a front view showing an oil pan of the oil storage device.
Figure 3:
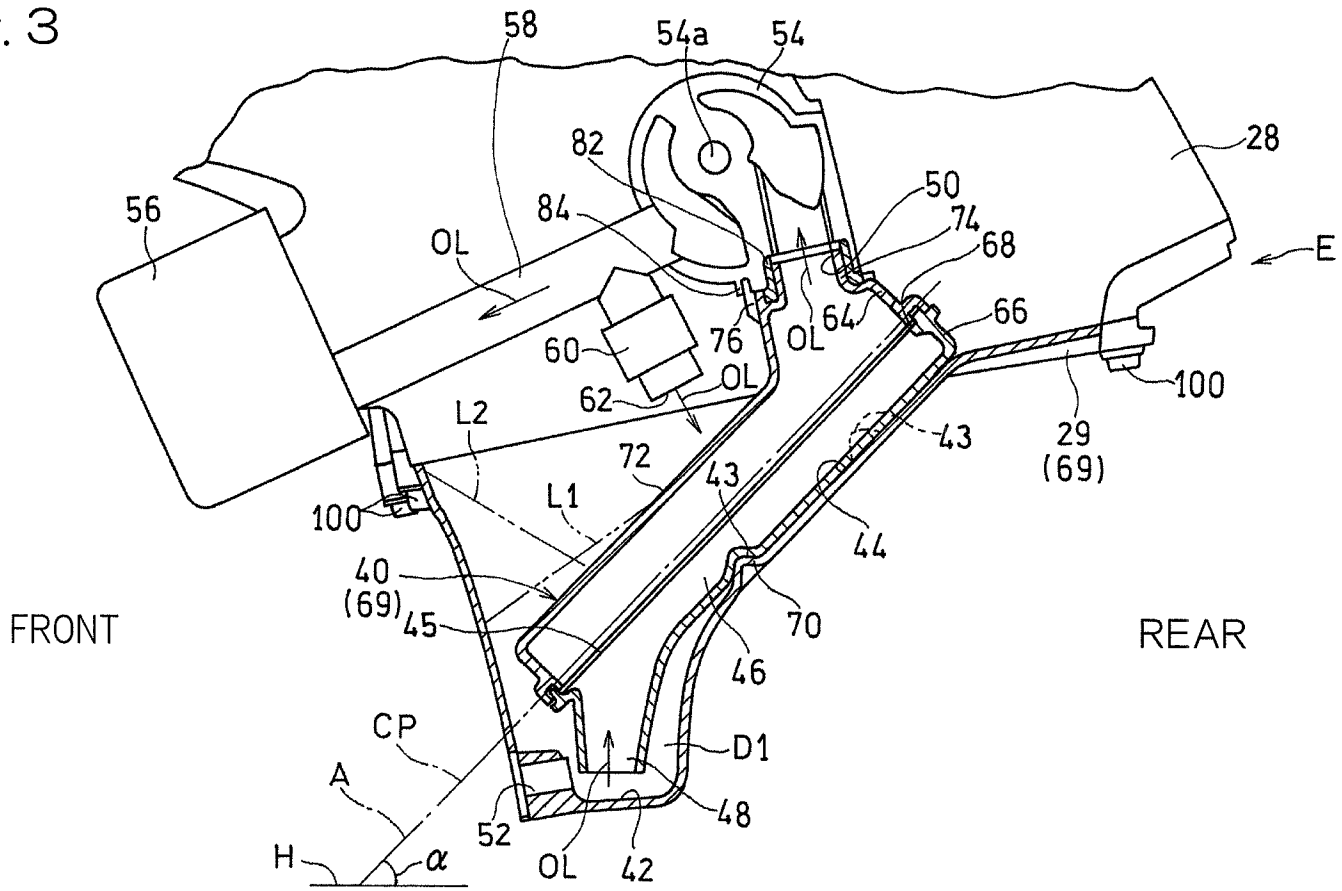
FIG. 3 is a longitudinal cross-sectional view including a lower portion of the oil pan of the combustion engine.

As shown in FIG. 2, the oil pan 29 includes a left half forming a deep portion D1 and a right half forming a shallow portion D2 shallower than the deep portion D1. The merging exhaust pipe 37 is located below the shallow portion D2. In other words, a bottom surface of the deep portion D1 is located below a bottom surface of the shallow portion D2, and a lower end of a portion of the oil pan 29, which portion corresponds to the deep portion D1, is located at substantially the same height as a lower end of the merging exhaust pipe 37. As shown in FIG. 3, in the deep portion D1, a deep portion bottom surface 42 forming a lowermost surface of the oil pan 29 is formed at the front side thereof, and an inclined surface 44 is formed so as to be inclined gradually upwardly in a rearward direction or towards the rear from the deep portion bottom surface 42. A plurality of seating surfaces 43 are formed on the inclined surface 44 so as to project upward.

As shown in FIG. 3, the oil strainer 40 includes a strainer main body 46 which extends along an inclined reference surface A inclined relative to a horizontal line H, a suction port 48 which is formed in a lower portion of the strainer main body 46, and a discharge port 50 which is formed in an upper portion of the strainer main body 46. A filter element 45 is accommodated in the strainer main body 46. The filter element 45 is, for example, a wire mesh. Specifically, the strainer main body 46 has an elongated substantially rectangular parallelepiped shape extending inclinedly upward from a front end thereof along the inclined reference surface A. The strainer main body 46 extends rearward and upward such that a central plane CP thereof in a side view coincides with the inclined reference surface A. In other words, the suction port 48 is formed in a front lower portion of the strainer main body 46, and the discharge port 50 is formed in a rear upper portion of the strainer main body 46.

Each of the suction port 48 and the discharge port 50 is formed in a tubular shape having an axis in the vertical direction. The strainer main body 46 is formed such that the area of a cross section (passage area) thereof perpendicular to the inclination direction in which the strainer main body 46 is inclined is sufficiently large as compared to the area of a cross section (passage area) of each of the suction port 48 and the discharge port 50 which is perpendicular to the direction of the axis thereof.

The inclination angle $\alpha$ of the inclined reference surface A is 35° to 55°, and is about 45° in the present embodiment. In the present embodiment, the angle of the inclined surface 44 of the oil pan 29 is also the same as the inclination angle $\alpha$ of the strainer main body 46, and the oil strainer 40 is disposed along the inclined surface 44.

The suction port 48 of the oil strainer 40 is located in the deep portion D1 of the oil pan 29. A drain hole 52 for draining the oil OL within the oil pan 29 is formed in a front wall of the deep portion D1 of the oil pan 29. That is, the suction port 48 and the drain hole 52 are located close to each other. In the present embodiment, the drain hole 52 is located in front of the suction port 48. In other words, the drain hole 52 and the discharge port 50 are located at opposite sides across the suction port 48. Accordingly, the oil OL that has flowed and dropped from the strainer main body 46 is effectively introduced into the drain hole 52, whereby it is possible to promote discharge of deteriorated oil.

An oil pump 54 is disposed within the crankcase 28 and above the discharge port 50 of the oil strainer 40, and the discharge port 50 and the oil pump 54 are fluidly connected to each other. The oil pump 54 has a rotary shaft 54*a* which is, for example, gear-connected or gear-meshed to the crankshaft 26 (FIG. 1), and rotates together with the crankshaft 26. An oil filter unit 56 is disposed in front of the oil pump 54 and on a front surface of the lower portion of the crankcase 28. The oil pump 54 and the oil filter unit 56 are fluidly connected to each other via an oil passage 58 which is formed within the crankcase 28 so as to extend in the front-rear direction.

A relief valve 60 is disposed on the oil passage 58, and returns the oil OL within the oil passage 58 to the oil pan 29 when a supply pressure for the oil OL is high. The relief valve 60 has an outlet 62 located above an upper surface 72 of the strainer main body 46.

The filter element 45 is also disposed so as to be inclined along the inclined reference surface A of the strainer main body 46, that is, disposed parallel to the inclined reference surface A. Specifically, the strainer main body 46 is configured by joining together an upper half 64 and a lower half 66 which are two shallow prolonged pan-shaped members separable from each other in a direction perpendicular to the inclined reference surface A. The filter element 45 is disposed at an abutting surface 68 where these two upper half 64 and lower half 66 abut each other and is held between the upper and lower halves 64 and 66. The discharge port 50 is formed in the upper half 64, and the suction port 48 is formed in the lower half 66.

Each of the upper half 64 and the lower half 66 is formed from a resin, and the upper and lower halves 64 and 66 are joined together by means of, for example, an adhesive, vibration welding, or the like. It is, however, to be noted that the material and the joining method of the upper and lower halves 64 and 66 are not limited thereto.

Figure 4:
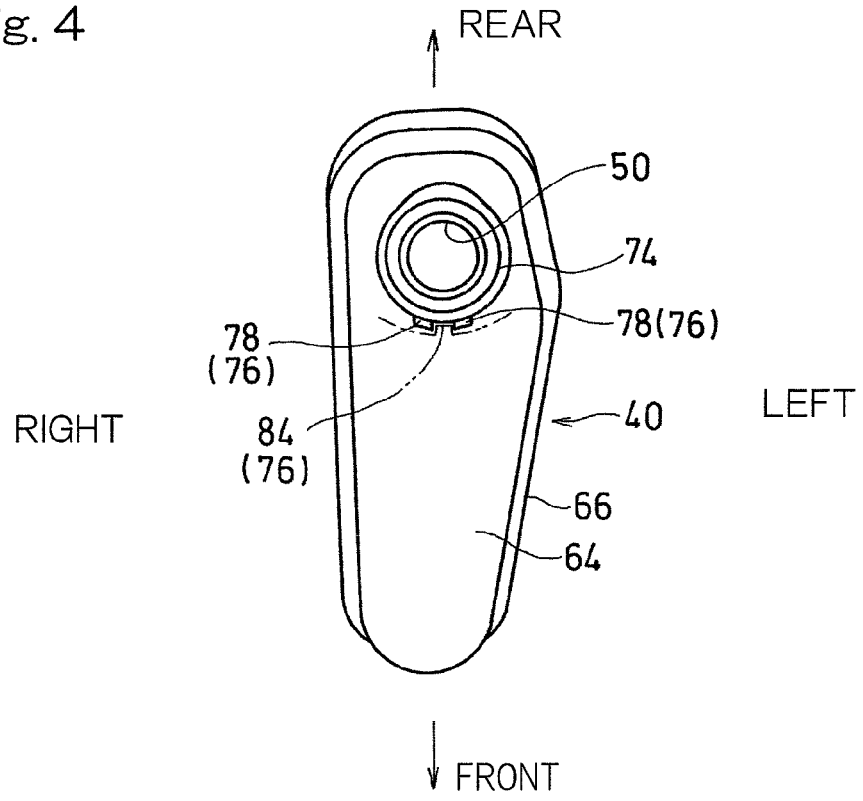
FIG. 4 is a plan view showing an oil strainer of the oil storage device.

FIG. 4 is a plan view of the oil strainer 40 as seen from above. As shown in FIG. 4, a discharge pipe portion 74 having the discharge port 50 is formed integrally with the upper half 64 of the strainer main body 46 by molding. The discharge pipe portion 74 has two stop projections 78, 78, which are formed so as to project frontward and constitute a part of rotation prevention unit 76. A single engagement projection 84 constituting the other part of the rotation prevention unit 76 is formed on a connection portion 82 of the crankcase 28 shown in FIG. 3, and the engagement projection 84 is engaged between the two stop projections 78, 78 such that the engagement projection 84 is not relatively movable in a circumferential direction of the discharge pipe portion 74.

Figure 5:
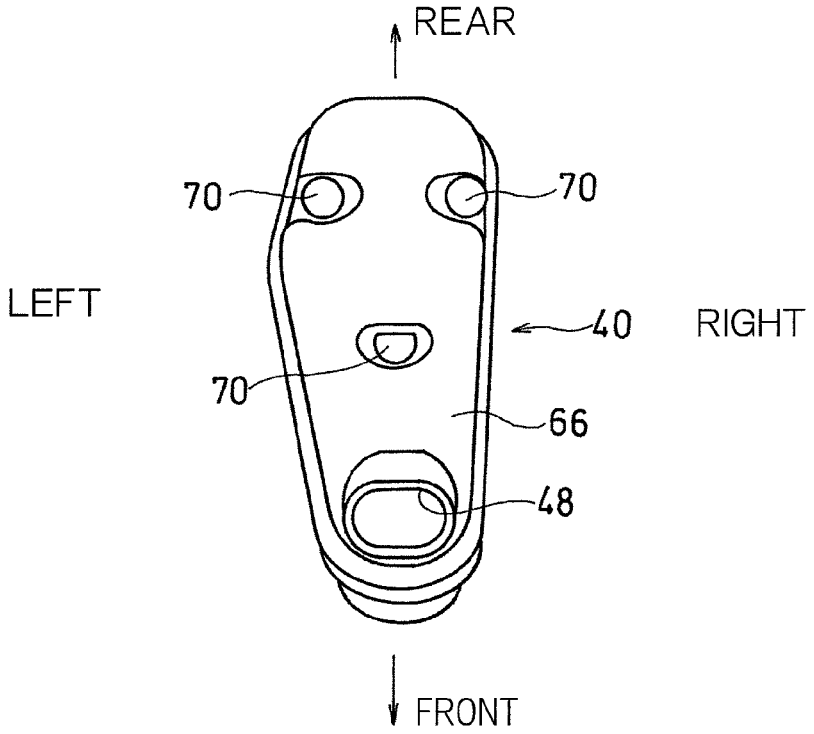
FIG. 5 is a bottom view showing the oil strainer of the oil storage device.

FIG. 5 is a bottom view of the oil strainer 40 as seen from below. A plurality of support surfaces 70 are formed on a lower surface of the lower half 66 of the strainer main body 46 so as to be recessed downward therefrom. As shown in FIG. 3, the support surfaces 70 are seated on the seating surfaces 43 of the inclined surface 44 of the oil pan 29. In this embodiment, three support surfaces 70 and three seating surfaces 43 are provided. Two of the support surfaces 70 are located in a rear portion of the lower half 66, and the other one of the support surfaces 70 is located in a center portion of the lower half 66 in the front-rear direction.

A method of assembling the oil strainer 40 and the oil storage device 69 will be described. First, in a state where the filter element 45 is disposed at the abutting surface 68 of the upper half 64 and the lower half 66, the upper half 64 and the lower half 66 are joined together by means of an adhesive to assemble the oil strainer 40.

Next, an O-ring (not shown) is mounted on the discharge pipe portion 74 of the oil strainer 40. Then, the discharge pipe portion 74 is inserted into the connection portion 82 of the crankcase 28 from below so that an upper portion of the oil strainer 40 is supported by the crankcase 28. At that time, the engagement projection 84 of the connection portion 82 is brought into engagement with the rotation prevention unit 76 of the discharge pipe portion 74. Accordingly, the discharge pipe portion 74 is prevented from rotating about an axis thereof.

Subsequently, the oil pan 29 is connected to the crankcase 28 by using bolts 100. At that time, the support surfaces 70 of the strainer main body 46 are seated on the seating surfaces 43 of the inclined surface 44 of the oil pan 29 so that a lower portion of the oil strainer 40 is supported by the crankcase 28 via the oil pan 29. In this manner, the oil strainer 40 and the oil storage device 69 are supported by the crankcase 28.

When the combustion engine E starts up, the oil pump 54 is driven in conjunction of the start-up of the combustion engine E. The oil OL within the oil pan 29 is introduced via the suction port 48 into the strainer main body 46 of the oil strainer 40, and then the oil OL is, after removing solid components or debris from the oil OL by the filter element 45, discharged through the discharge port 50.

The oil OL discharged through the discharge port 50 is introduced into the oil pump 54, and then is, after pressurized by the oil pump 54, supplied via the oil passage 58 to the oil filter unit 56. The oil OL is cleaned by the oil filter unit 56 and then supplied via an oil cooler (not shown) to each component of the combustion engine E to lubricate and cool each component.

When the pressure within the oil passage 58 is high, the relief valve 60 opens to return the oil OL within the oil passage 58 to the oil pan 29. At that time, the oil OL discharged through the outlet 62 of the relief valve 60 comes into contact with the upper surface 72 of the oil strainer 40 and flows down along the inclined upper surface 72. Thus, bubbles do not occur on an oil surface within the oil pan 29.

During acceleration or deceleration of the motorcycle, the oil surface within the oil pan 29 is inclined as shown by double dotted lines L1 and L2 (FIG. 3). An oil surface L1 indicates an oil surface during acceleration, and an oil surface L2 indicates an oil surface during deceleration. Even during acceleration or deceleration, since a lower portion of the deep portion D1 of the oil pan 29 is formed so as to have the deep portion bottom surface 42 and the inclined surface 44 such that the suction port 48 is immersed in the oil, air is not sucked through the suction port 48. That is, the inclination angle of the inclined reference surface A, which is the inclination angle of the inclined surface 44 of the oil pan 29, and the inclination angle $\alpha$ of the strainer main body 46, which extends along the inclined reference surface A, are determined on the basis of the inclined oil surfaces L1 and L2.

In addition, since the strainer main body 46 is inclined gradually upwardly towards the rear, a force is applied in a direction, in which the oil OL moves toward the suction port 48, due to an inertial force during acceleration. Thus, it is possible to prevent oil supply from being insufficient during acceleration in which a large amount of oil circulation is required.

Figure 6A:
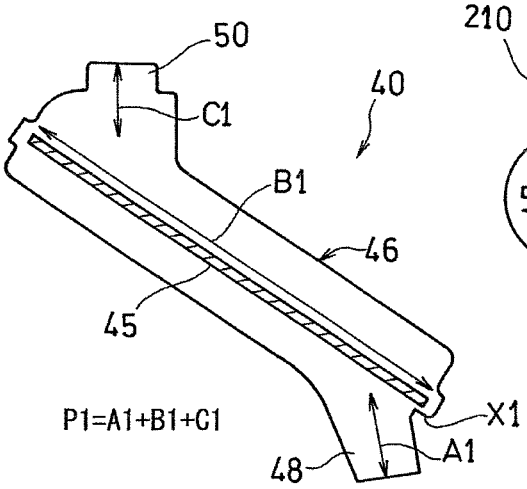
FIG. 6A is a side view showing the oil strainer.
Figure 6B:
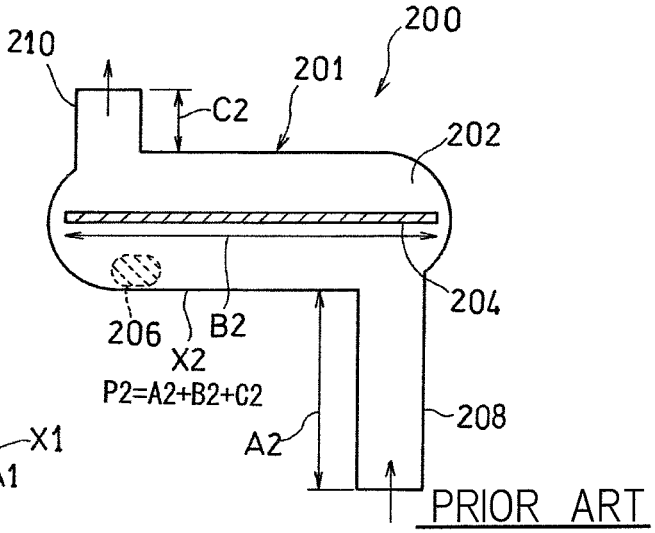
FIG. 6B is a side view showing a conventional oil strainer.

FIGS. 6A and 6B show a comparison between the oil strainer 40 according to the present embodiment and the conventional oil strainer 200 when a position of suction and a position of discharge are set to be the same in these strainers 40 and 200. In the conventional oil strainer 200 shown in FIG. 6B, the strainer main body 201 horizontally extends.

An oil passage length P1 within the oil strainer 40 according to the present embodiment shown in FIG. 6A is the sum of a length A1 of the suction port 48 in its axial direction, a length B1 of the strainer main body 46 in its extending direction, and a length C1 of the discharge port 50 in its axial direction (A1+B1+C1). Meanwhile, an oil passage length P2 within the oil strainer 200 in FIG. 6B is the sum of a length A2 of a suction port 208 in its axial direction, a length B2 of the strainer main body 201 in its extending direction, and a length C2 of a discharge port 210 in its axial direction (A2+B2+C2).

In the oil strainer 40 according to the present embodiment shown in FIG. 6A, since the strainer main body 46 is disposed so as to be inclined, the oil passage length P1 is shorter than the oil passage length P2 of the conventional oil strainer 200 shown in FIG. 6B ((A1+B1+C1)<(A2+B2+C2)). Thus, it is possible to decrease the passage resistance.

In addition, the length B1 of the strainer main body 46 in its extending direction in FIG. 6A is larger than the length B2 of the strainer main body 201 in its extending direction in FIG. 6B, and thus it is possible to make the filter area of the filter element 45 in FIG. 6A larger than the filter area of a filter element 204 in FIG. 6B. As a result, the passage resistance, when the oil OL passes through the strainer main body 46, is decreased.

Furthermore, it is possible to dispose a lower end portion X1 of the strainer main body 46 in FIG. 6A at a position lower than a lower end portion X2 of the strainer main body 201 in FIG. 6B. Thus, it is possible to immerse the lower portion of the strainer main body 46 in the oil without increasing the area, in the horizontal direction, of the lower portion of the deep portion D1 (FIG. 2) of the oil pan 29. As a result, it is possible to shorten the passage length and also to decrease the passage resistance.

In addition, in the conventional oil strainer 200 in FIG. 6B, there is concern that air remains in the strainer main body 201 extending in the horizontal direction and such remaining air is introduced through the discharge port 210 into a pump to cause an air entrainment phenomenon. Meanwhile, in the oil strainer 40 according to the present embodiment in FIG. 6A, since the strainer main body 46 is disposed so as to be inclined, remaining of air in the strainer main body 46 is suppressed.

In the above-described configuration, since the strainer main body 46, which accommodates the filter element 45, is inclined, when the combustion engine E stops, foreign matters in the oil OL within the strainer main body 46 flow along the inclined strainer main body 46 and drop into the oil pan 29. Therefore, foreign matters are prevented from remaining in the oil OL within the strainer main body 46. Thus, deteriorated oil is easily discharged at the time of oil replacement. As a result, it is possible to reduce a remaining amount of deteriorated oil and to replace the oil with a new oil, and thus it is possible to prevent a decrease in the combustion engine performance and to improve the durability of the combustion engine.

In addition, since the filter element 45 is also disposed so as to be inclined along the inclined reference surface A which extends in the extending direction of the strainer main body 46, it is possible to make the filter area large as compared to the case where the filter element is horizontally disposed. As a result, the passage resistance when the oil OL passes through the strainer main body 46 is decreased. Accordingly, it is possible to stably supply the oil while preventing the ability of the oil pump 54 from being excessive.

Furthermore, since the filter element 45 is disposed at the abutting surface 68 of the upper half 64 and the lower half 66, it is possible to easily dispose the filter element 45 within the strainer main body 46 such that the filter element 45 is inclined, and also it is easy to mount and dismount the filter element 45 to improve maintenability.

In addition, since the oil strainer 40 is disposed along the inclined surface 44 of the oil pan 29, it is possible to dispose the strainer main body 46, which is inclined, elongated, and large in size, in accordance with the shape of the oil pan 29.

Furthermore, the discharge pipe portion 74 of the oil strainer 40 is inserted into the connection portion 82 of the crankcase 28 from below, and the support surfaces 70 of the oil strainer 40 are seated on the inclined surface 44 of the oil pan 29. Therefore, it is possible to stably support the oil strainer 40 by the oil pan 29.

Moreover, the outlet 62 of the relief valve 60 confronts the upper surface 72 of the strainer main body 46 from above. Accordingly, the oil OL discharged through the outlet 62 flows on the upper surface 72 of the strainer main body 46, whereby it is possible to suppress occurrence of bubbles in the oil OL within the oil pan 29.

The present invention is not limited to the embodiment described above, and various additions, modifications, or deletions may be made without departing from the gist of the invention. For example, in the embodiment described above, the strainer main body 46 is disposed so as to be inclined gradually upwardly towards the rear, but the inclination direction thereof is not limited thereto. The oil strainer 40 according to the present invention is suitably used for a combustion engine having high requirements of lubrication and cooling by oil, such as a high-power combustion engine including a supercharger. For example, the oil strainer 40 according to the present invention is suitably used for a combustion engine that requires lubrication of a supercharger, lubrication of a power transmission system from the crankshaft 26 to the supercharger, jet-spraying of oil to a back surface of each piston, and the like. However, the oil strainer 40 according to the present invention is also applicable to a combustion engine that does not include a supercharger.

The oil strainer 40 and the oil storage device 69 according to the present invention are suitably used for a motorcycle, but are also applicable to vehicles other than a motorcycle. Furthermore, the oil strainer 40 according to the present invention is also applicable to a combustion engine for a ship or a combustion engine installed on the ground. Therefore, these are construed as included within the scope of the present invention.

REFERENCE NUMERALS

28 . . . crankcase
29 . . . oil pan

40 . . . oil strainer
43 . . . seating surface
44 . . . inclined surface
45 . . . filter element
46 . . . strainer main body
48 . . . suction port
50 . . . discharge port
60 . . . relief valve
62 . . . outlet (inlet)
64 . . . upper half (pan-shaped member)
66 . . . lower half (pan-shaped member)
68 . . . abutting surface
69 . . . oil storage device
70 . . . support surface
A . . . inclined reference surface
E . . . combustion engine
OL . . . oil

What is claimed is:

1. An oil storage device for a vehicle comprising:
an oil pan connected to a lower portion of a combustion engine; and
an oil strainer disposed within the oil pan connected to a lower portion of a combustion engine, the oil strainer sucking an oil, wherein
the oil strainer comprises:
a strainer main body accommodating a filter element and extending along an inclined reference plane inclined relative to a horizontal line;
a suction port formed in a lower portion of the strainer main body; and
a discharge port formed in an upper portion of the strainer main body, an inclined surface is formed on an inner bottom surface of the oil pan so as to extend gradually upwardly in one of frontward and rearward directions of the vehicle,
the oil strainer is disposed along the inclined surface,
a discharge pipe portion having the discharge port is inserted into a connection portion provided in a crankcase of the combustion engine, from below,
a support surface is formed on the strainer main body, the support surface being concaved upwardly from a lower surface of the strainer main body, and
a seating surface on which the support surface is seated is formed on the inclined surface, the seating surface projecting upwardly from the inclined surface.

2. The oil storage device for the vehicle as claimed in claim 1, wherein an inlet through which an oil is introduced into the oil pan confronts an upper surface of the strainer main body from above.

3. The oil storage device for the vehicle as claimed in claim 2, wherein the inlet is an outlet of a relief valve of an oil passage.

4. The oil storage device for the vehicle as claimed in claim 1, wherein the strainer main body is inclined gradually upwardly towards the rear of the vehicle.

5. The oil storage device for the vehicle as claimed in claim 1, wherein
the oil pan includes a deep portion and a shallow portion shallower than the deep portion,
the suction port of the oil strainer is located in the deep portion of the oil pan, and
a drain hole for draining the oil within the oil pan is formed in a wall of the deep portion of the oil pan.

6. The oil storage device for the vehicle as claimed in claim 1, wherein the lower surface of the strainer main body extends in the vicinity of and substantially parallel to the inclined surface.

7. A motorcycle comprising an oil storage device, which oil storage device comprises:
an oil pan connected to a lower portion of a combustion engine; and
an oil strainer disposed within the oil pan, the oil strainer sucking an oil, wherein the oil strainer comprises:
a strainer main body accommodating a filter element and extending along an inclined reference plane inclined relative to a horizontal line, wherein a support surface is formed on the strainer's main body, the support surface having a plurality of upwardly concaved portions and the oil pan includes upwardly concaved portions spaced and aligned with the plurality of upward concaved portions of the support surface;
a suction port formed in a lower portion of the strainer main body; and
a discharge port formed in an upper portion of the strainer main body,
an inclined surface is formed on an inner bottom surface of the oil pan so as to extend gradually upwardly in one of frontward and rearward directions of the vehicle,
the oil strainer is disposed such that a lower surface of the strainer main body extends along the inclined surface,
the oil pan includes a deep portion located on one side in a vehicle widthwise direction and a shallow portion located on the other side in the vehicle widthwise direction, a deep portion bottom surface being positioned lower than a shallow portion bottom surface, and
an exhaust pipe is fluidly connected with an exhaust port in a front surface of a cylinder head of the combustion engine, and extends rearwardly below the shallow portion to be fluidly connected with a muffler at a location rearwardly of the combustion engine.

8. The motorcycle as claimed in claim 7, wherein a lower end of a portion of the oil pan, which portion corresponds to the deep portion, is located at substantially the same height as a lower end of the exhaust pipe.

9. The motorcycle as claimed in claim 7, wherein
the deep portion bottom surface forming a lowermost surface of the oil pan, is formed in the deep portion, and
the inclined surface is inclined gradually upwardly towards the rear from the deep portion bottom surface.

* * * * *